US012419348B2

(12) United States Patent
Naughton et al.

(10) Patent No.: US 12,419,348 B2
(45) **Date of Patent: *Sep. 23, 2025**

(54) APPARATUS FOR HEATING SMOKABLE MATERIAL

(71) Applicant: NICOVENTURES TRADING LIMITED, London (GB)

(72) Inventors: Michael Naughton, Oconomowoc, WI (US); Mitchel Thorsen, Madison, WI (US)

(73) Assignee: NICOVENTURES TRADING LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/327,225

(22) Filed: Jun. 1, 2023

(65) Prior Publication Data

US 2023/0301348 A1 Sep. 28, 2023

Related U.S. Application Data

(63) Continuation of application No. 17/445,850, filed on Aug. 25, 2021, now Pat. No. 11,700,883, which is a (Continued)

(51) Int. Cl.
*A24F 40/40* (2020.01)
*A24F 40/20* (2020.01)
*A24F 40/46* (2020.01)

(52) U.S. Cl.
CPC ..... *A24F 40/40* (2020.01); *A24F 40/20* (2020.01); *A24F 40/46* (2020.01)

(58) Field of Classification Search
CPC ..... A24F 2700/03; A24F 47/008; A24F 7/00; A24F 1/00
See application file for complete search history.

(56) References Cited

U.S. PATENT DOCUMENTS 174,884 A 3/1876 Wolff
239,198 A 3/1881 Simonds
(Continued)

FOREIGN PATENT DOCUMENTS

AR 088426 A1 6/2014
AU 2016282378 A1 1/2018
(Continued)

OTHER PUBLICATIONS

"British American Tobacco to Test Tobacco E-cigarette in Japan", Reuters, Available online <http://www.reuters.com/article/Us-brit-am-tobacco-ecigarettes-idUSKBN1330AG>, 4 pages.
(Continued)

*Primary Examiner* — Xiao S Zhao
*Assistant Examiner* — Guy F Mongelli
(74) *Attorney, Agent, or Firm* — MERCHANT & GOULD P.C.

(57) ABSTRACT

An apparatus arranged to heat smokable material to volatilize at least one component of the smokable material has a housing. The housing has a first opening at a first end through which smokable material can pass so as to be received within and removed from the apparatus in use. The housing has a second opening at a second end opposed from the first end. The housing further has a chamber between the first and second openings. At least one heater is arranged within the housing for heating smokable material removably received within the chamber in use. A user can access the chamber through at least the second opening to clean within the apparatus.

16 Claims, 5 Drawing Sheets

Related U.S. Application Data continuation of application No. 15/737,673, filed as application No. PCT/EP2016/064756 on Jun. 24, 2016, now Pat. No. 11,134,717.

(60) Provisional application No. 62/185,227, filed on Jun. 26, 2015.

(56) References Cited

U.S. PATENT DOCUMENTS 239,776 A 4/1881 Henley
D22,270 S 3/1893 Kinney
D27,458 S 8/1897 Cameron, Jr.
1,927,956 A 9/1933 Samuel
2,371,557 A 3/1945 Sullivan
D164,391 S 8/1951 Wagner
3,236,243 A 2/1966 Seymour
3,519,000 A 7/1970 Houser
D239,631 S 4/1976 Gilles
D239,776 S 5/1976 Kenjiro
4,214,658 A 7/1980 Crow
4,226,250 A 10/1980 Ehrenpreis et al.
D284,506 S 7/1986 Gutknecht
D301,837 S 6/1989 Peterson et al.
D303,766 S 10/1989 Delbanco
5,144,962 A 9/1992 Counts et al.
D360,281 S 7/1995 Kim
5,564,442 A 10/1996 Macdonald et al.
5,649,554 A 7/1997 Sprinkel et al.
5,665,262 A 9/1997 Hajaligol et al.
5,692,291 A 12/1997 Deevi et al.
5,708,258 A 1/1998 Counts et al.
5,878,752 A 3/1999 Adams et al.
5,954,979 A 9/1999 Counts et al.
D422,113 S 3/2000 Higgins et al.
D424,236 S 5/2000 Reed
6,158,530 A 12/2000 Bowen et al.
D437,112 S 2/2001 Toffoli
D446,849 S 8/2001 Weinberg
6,418,938 B1 7/2002 Fleischhauer et al.
D506,001 S 6/2005 Christianson
D512,493 S 12/2005 Haranaka
D538,222 S 3/2007 Curello et al.
D558,060 S 12/2007 Hacek
D558,330 S 12/2007 Chang
D576,718 S 9/2008 Nomi et al.
D634,417 S 3/2011 Abbondanzio et al.
D634,832 S 3/2011 Abbondanzio et al.
D643,732 S 8/2011 Cummings et al.
7,988,660 B2 8/2011 Byland et al.
D645,757 S 9/2011 Milhem et al.
D648,340 S 11/2011 Okura
D650,472 S 12/2011 Petersen
D654,160 S 2/2012 Yomtov
D657,857 S 4/2012 Choi
D663,891 S 7/2012 Cohen
D664,709 S 7/2012 Almsberger et al.
D665,734 S 8/2012 Fitch et al.
D674,479 S 1/2013 Merchant et al.
D677,623 S 3/2013 Fitch et al.
D677,774 S 3/2013 Postma
8,528,780 B2 9/2013 Houghton et al.
D695,396 S 12/2013 Tani et al.
D696,815 S 12/2013 Abroff
D700,397 S 2/2014 Manca et al.
D704,319 S 5/2014 Cai
D708,129 S 7/2014 Houghton et al.
D708,727 S 7/2014 Postma
D714,647 S 10/2014 Kersten
D715,760 S 10/2014 Kim et al.
D716,267 S 10/2014 Kim et al.
8,915,254 B2 * 12/2014 Monsees ..... A24D 1/14 131/194
D728,855 S 5/2015 Liu
D729,440 S 5/2015 Liu
D729,445 S 5/2015 Leidel
D732,023 S 6/2015 Asao
D736,455 S 8/2015 Liu
D740,673 S 10/2015 Corradini et al.
D743,099 S 11/2015 Oglesby
D743,889 S 11/2015 Lyles et al.
D745,404 S 12/2015 Julier et al.
D746,771 S 1/2016 Perez
D758,656 S 6/2016 Freshwater et al.
D759,296 S 6/2016 Abroff et al.
D760,414 S 6/2016 Brown et al.
D768,834 S 10/2016 Schuller et al.
D771,867 S 11/2016 Leidel et al.
D773,114 S 11/2016 Leidel et al.
9,499,332 B2 11/2016 Fernando et al.
D775,762 S 1/2017 Chen
D778,831 S 2/2017 Chen
D787,657 S 5/2017 Farone et al.
D787,728 S 5/2017 Wing et al.
D788,364 S 5/2017 Chen
D807,575 S 1/2018 Luo
D818,637 S 5/2018 Ringel
D819,023 S 5/2018 Shim
D821,640 S 6/2018 Qiu
D828,295 S 9/2018 Li
D828,622 S 9/2018 Chen et al.
D828,912 S 9/2018 Powell et al.
D828,950 S 9/2018 Gu
D828,953 S 9/2018 Chen
D833,384 S 11/2018 Takayanagi
10,136,679 B1 11/2018 Shotey et al.
D835,857 S 12/2018 Benacquisto et al.
D839,823 S 2/2019 Lemelson et al.
10,194,697 B2 2/2019 Fernando et al.
D842,237 S 3/2019 Qiu et al.
D842,243 S 3/2019 Qiu
D843,052 S 3/2019 Powell et al.
D844,030 S 3/2019 You
D848,603 S 5/2019 Fujino et al.
D853,022 S 7/2019 Srour
D854,236 S 7/2019 Qiu
D861,549 S 10/2019 Lai
D869,086 S 12/2019 Pan
D870,367 S 12/2019 Chung et al.
D872,355 S 1/2020 Powell et al.
D876,214 S 2/2020 Yu
D881,458 S 4/2020 Ouyang
D883,197 S 5/2020 Doucet
D883,563 S 5/2020 Pan
D884,266 S 5/2020 Wang
D884,961 S 5/2020 He
D885,332 S 5/2020 Han
D885,337 S 5/2020 Xu
D885,651 S 5/2020 Miyamoto
D888,326 S 6/2020 Qiu
D888,329 S 6/2020 Qiu
D889,740 S 7/2020 Beer et al.
D891,692 S 7/2020 Barbaric et al.
D892,124 S 8/2020 Shim
D893,009 S 8/2020 Choi
D894,476 S 8/2020 Miyamoto
D896,519 S 9/2020 Cooper et al.
D897,596 S 9/2020 Huang et al.
D898,280 S 10/2020 Li et al.
D898,990 S 10/2020 Liu et al.
D898,991 S 10/2020 Pan
10,791,765 B2 10/2020 Li et al.
D901,072 S 11/2020 Goradesky
D904,401 S 12/2020 Wu
D904,678 S 12/2020 Wang et al.
D905,901 S 12/2020 Kim et al.
D908,344 S 1/2021 Jones
D908,834 S 1/2021 Cho et al.
D908,952 S 1/2021 Guo
11,134,717 B2 * 10/2021 Naughton ..... A24F 40/85
11,700,883 B2 * 7/2023 Naughton ..... A24F 40/85 131/330
2003/0150451 A1 8/2003 Shayan
2004/0025865 A1 2/2004 Nichols et al.

(56) References Cited

U.S. PATENT DOCUMENTS

| | | | | |
|---|---|---|---|---|
| 2005/0199610 | A1 | 9/2005 | Ptasienski et al. | |
| 2007/0074734 | A1 | 4/2007 | Braunshteyn et al. | |
| 2007/0283972 | A1 | 12/2007 | Monsees et al. | |
| 2008/0149118 | A1 | 6/2008 | Oglesby et al. | |
| 2009/0014640 | A1* | 1/2009 | Schaumloffel | B05B 7/066 239/338 |
| 2009/0114737 | A1 | 5/2009 | Yu et al. | |
| 2009/0145448 | A1 | 6/2009 | Worlock et al. | |
| 2009/0320864 | A1 | 12/2009 | Rowley | |
| 2010/0218778 | A1 | 9/2010 | Borden | |
| 2010/0236561 | A1 | 9/2010 | Barnes et al. | |
| 2010/0275779 | A1* | 11/2010 | Melikyan | C02F 9/20 96/396 |
| 2011/0108025 | A1 | 5/2011 | Fink et al. | |
| 2011/0240047 | A1 | 10/2011 | Adamic | |
| 2011/0290244 | A1 | 12/2011 | Schennum | |
| 2012/0060853 | A1* | 3/2012 | Robinson | A24D 1/20 131/191 |
| 2013/0042865 | A1 | 2/2013 | Monsees et al. | |
| 2014/0060554 | A1 | 3/2014 | Collett et al. | |
| 2014/0069444 | A1 | 3/2014 | Cyphert et al. | |
| 2014/0196718 | A1 | 7/2014 | Li et al. | |
| 2014/0338680 | A1 | 11/2014 | Abramov et al. | |
| 2014/0366898 | A1 | 12/2014 | Monsees et al. | |
| 2015/0027455 | A1* | 1/2015 | Peleg | A24F 40/30 131/328 |
| 2015/0053217 | A1* | 2/2015 | Steingraber | A24F 40/50 131/329 |
| 2015/0059787 | A1 | 3/2015 | Qiu | |
| 2015/0101606 | A1 | 4/2015 | White | |
| 2015/0101944 | A1 | 4/2015 | Li et al. | |
| 2015/0181934 | A1* | 7/2015 | Lyubomirskiy | A24F 40/46 131/329 |
| 2015/0181937 | A1 | 7/2015 | Dubief et al. | |
| 2015/0189919 | A1 | 7/2015 | Liu | |
| 2015/0245658 | A1 | 9/2015 | Worm et al. | |
| 2015/0257447 | A1 | 9/2015 | Sullivan | |
| 2016/0007652 | A1 | 1/2016 | Taluskie et al. | |
| 2016/0081395 | A1 | 3/2016 | Thorens et al. | |
| 2016/0150828 | A1* | 6/2016 | Goldstein | H05B 6/36 392/387 |
| 2016/0255879 | A1 | 9/2016 | Paprocki et al. | |
| 2017/0231276 | A1 | 8/2017 | Mironov et al. | |
| 2017/0232211 | A1 | 8/2017 | Gallem et al. | |
| 2018/0168224 | A1 | 6/2018 | Naughton et al. | |
| 2018/0271151 | A1 | 9/2018 | Litten | |
| 2019/0029326 | A1 | 1/2019 | Qiu | |
| 2019/0046745 | A1 | 2/2019 | Nettenstrom et al. | |
| 2019/0150508 | A1 | 5/2019 | Thorsen et al. | |
| 2019/0166918 | A1 | 6/2019 | Thorsen et al. | |
| 2019/0200678 | A1 | 7/2019 | Thorson et al. | |
| 2019/0208815 | A1 | 7/2019 | Thorsen | |
| 2019/0208816 | A1 | 7/2019 | Thorsen | |
| 2019/0208817 | A1 | 7/2019 | Qiu et al. | |
| 2019/0246693 | A1 | 8/2019 | Nettenstrom et al. | |
| 2019/0387799 | A1 | 12/2019 | Reevell | |
| 2020/0187555 | A1 | 6/2020 | Lee | |
| 2020/0245681 | A1 | 8/2020 | An | |
| 2020/0253280 | A1 | 8/2020 | Thorsen | |
| 2020/0345075 | A1 | 11/2020 | Hepworth | |
| 2020/0345960 | A1 | 11/2020 | Begin et al. | |
| 2020/0359706 | A1 | 11/2020 | Liu | |
| 2021/0000169 | A1 | 1/2021 | Hepworth | |
| 2021/0007401 | A1 | 1/2021 | Moloney et al. | |

FOREIGN PATENT DOCUMENTS

| | | | |
|---|---|---|---|
| AU | 2018246327 | B2 | 6/2021 |
| CN | 1122213 | A | 5/1996 |
| CN | 1126425 | A | 7/1996 |
| CN | 1190335 | A | 8/1998 |
| CN | 2393345 | Y | 8/2000 |
| CN | 1333657 | A | 1/2002 |
| CN | 1491598 | A | 4/2004 |
| CN | 1633247 | A | 6/2005 |
| CN | 1212785 | C | 8/2005 |
| CN | 1264440 | C | 7/2006 |
| CN | 1947462 | A | 4/2007 |
| CN | 101044795 | A | 9/2007 |
| CN | 101912654 | A | 12/2010 |
| CN | 202085709 | U | 12/2011 |
| CN | 102595943 | A | 7/2012 |
| CN | 102753047 | A | 10/2012 |
| CN | 202819632 | U | 3/2013 |
| CN | 203399710 | U | 1/2014 |
| CN | 103596458 | A | 2/2014 |
| CN | 103763953 | A | 4/2014 |
| CN | 103763954 | A | 4/2014 |
| CN | 103919279 | A | 7/2014 |
| CN | 103974639 | A | 8/2014 |
| CN | 104203015 | A | 12/2014 |
| CN | 104219973 | A | 12/2014 |
| CN | 204032371 | U | 12/2014 |
| CN | 104256898 | A | 1/2015 |
| CN | 204146325 | U | 2/2015 |
| CN | 104394721 | A | 3/2015 |
| CN | 104768407 | A | 7/2015 |
| CN | 104770894 | A | 7/2015 |
| CN | 105361249 | A | 3/2016 |
| CN | 205052881 | U | 3/2016 |
| CN | 205072064 | U | 3/2016 |
| CN | 205072072 | U | 3/2016 |
| CN | 304659647 | | 6/2018 |
| CN | 304659654 | | 6/2018 |
| CN | 304691359 | | 6/2018 |
| CN | 304696494 | | 6/2018 |
| CN | 304724787 | | 7/2018 |
| CN | 304840668 | | 10/2018 |
| CN | 304854337 | | 10/2018 |
| CN | 304935891 | | 12/2018 |
| CN | 109195463 | A | 1/2019 |
| CN | 305060127 | | 3/2019 |
| CN | 305162683 | | 5/2019 |
| CN | 305475358 | | 12/2019 |
| CN | 107809919 | B | 7/2021 |
| DE | 19854005 | A1 | 5/2000 |
| DE | 19854009 | A1 | 5/2000 |
| DK | 102011119176 | A1 | 2/2013 |
| EM | 26114260001 | | 3/2015 |
| EM | 27270990001 | | 9/2017 |
| EM | 27270990007 | | 9/2017 |
| EM | 29810430001 | | 5/2018 |
| EP | 0917830 | A1 | 5/1999 |
| EP | 2316286 | A1 | 5/2011 |
| EP | 2340729 | A1 | 7/2011 |
| EP | 2797448 | A2 | 11/2014 |
| EP | 3954238 | A2 | 2/2022 |
| GB | 191000639 | A | 12/1910 |
| GB | 1400655 | A | 7/1975 |
| JP | S59161 | U | 1/1984 |
| JP | 1991108472 | A | 5/1991 |
| JP | H03108472 | A | 5/1991 |
| JP | H03232481 | A | 10/1991 |
| JP | 5090161 | U | 12/1993 |
| JP | H0590161 | U | 12/1993 |
| JP | 2000236865 | A | 9/2000 |
| JP | 2001521123 | A | 11/2001 |
| JP | 3392138 | B2 | 3/2003 |
| JP | 2003527127 | A | 9/2003 |
| JP | 2005510968 | A | 4/2005 |
| JP | 2006223158 | A | 8/2006 |
| JP | 2009509521 | A | 3/2009 |
| JP | 2013509160 | A | 3/2013 |
| JP | 5510968 | B2 | 6/2014 |
| JP | 2014520542 | A | 8/2014 |
| JP | 2014524313 | A | 9/2014 |
| JP | 2014525251 | A | 9/2014 |
| JP | 2014533513 | A | 12/2014 |
| JP | 2015519915 | A | 7/2015 |
| JP | 2015521847 | A | 8/2015 |
| JP | 2016534730 | A | 11/2016 |
| JP | 6539756 | B2 | 7/2019 |
| JP | 6737902 | B2 | 8/2020 |

(56) References Cited

FOREIGN PATENT DOCUMENTS

| | | | |
|---|---|---|---|
| JP | 6764505 | B2 | 9/2020 |
| KR | 178388 | B1 | 2/1999 |
| KR | 20010089445 | A | 10/2001 |
| KR | 100304044 | B1 | 11/2001 |
| KR | 100404704 | B1 | 10/2004 |
| KR | 100495099 | B1 | 11/2005 |
| KR | 20070108215 | A | 11/2007 |
| KR | 20090011236 | U | 11/2009 |
| KR | 20100035492 | A | 4/2010 |
| KR | 20110115143 | A | 10/2011 |
| KR | 102233850 | B1 | 3/2021 |
| RU | 76781 | U1 | 10/2008 |
| RU | 2351131 | C2 | 4/2009 |
| RU | 2600092 | C2 | 10/2016 |
| WO | 8602528 | A1 | 5/1986 |
| WO | 9219081 | A1 | 10/1992 |
| WO | 9406314 | A1 | 3/1994 |
| WO | 9527412 | A1 | 10/1995 |
| WO | 9741744 | A1 | 11/1997 |
| WO | 9748295 | A1 | 12/1997 |
| WO | 9920939 | A1 | 4/1999 |
| WO | 27232 | A1 | 5/2000 |
| WO | 170054 | A1 | 9/2001 |
| WO | 3056948 | A1 | 7/2003 |
| WO | 2007039794 | A2 | 4/2007 |
| WO | 2010047389 | A1 | 4/2010 |
| WO | 2010095659 | A1 | 8/2010 |
| WO | 2011118024 | A1 | 9/2011 |
| WO | 2013025921 | A1 | 2/2013 |
| WO | 2013034460 | A1 | 3/2013 |
| WO | 2013055194 | A2 | 4/2013 |
| WO | 2013076098 | A2 | 5/2013 |
| WO | 2013098396 | A2 | 7/2013 |
| WO | 2013098397 | A2 | 7/2013 |
| WO | 2013160112 | A2 | 10/2013 |
| WO | 2014047954 | A1 | 4/2014 |
| WO | 2015062983 | A2 | 5/2015 |
| WO | 2015091258 | A1 | 6/2015 |
| WO | 2015166245 | A2 | 11/2015 |
| WO | 2016012774 | A1 | 1/2016 |
| WO | 2016207407 | A1 | 12/2016 |
| WO | 2017194762 | A1 | 11/2017 |
| WO | 2017194763 | A2 | 11/2017 |
| WO | 2017194764 | A1 | 11/2017 |
| WO | 2017194766 | A1 | 11/2017 |
| WO | 2017194769 | A1 | 11/2017 |
| WO | 2018019786 | A1 | 2/2018 |
| WO | D200284-003 | | 8/2020 |

OTHER PUBLICATIONS

"FlowerMate Vopormax-V Portable Marijuana Vaporizer", Shown at: https://www.youtube.com/watch?v=S3bAYHIf_i4, Aug. 22, 2014, 1 page.
"Glo E-cigarette", retrieved from https://ifworlddesignguide.com/entry/235574-glo, 4 pages.
"Goboof Alfa", retrieved at:https://www.youtube.com/watch?v=I39A90Xp-yl, on Nov. 22, 2014, 1 page.
"Handbook of Advanced Robotics", [US] E. L. Safford, Translated by Li, Deming et al., Shanghai Translation Publishing Company, 1st edition, pp. 162-163.
"QOQ Honor & Smart", By H KL Reviews, Found online at https://www.youtube.com/watch?v=veLv8NX6smE, 1 page.
Application and File History for U.S. Appl. No. 16/099,315, filed Nov. 6, 2018.
Application and File History for U.S. Appl. No. 29/676,726, filed Jan. 14, 2019.
Application and Filing Receipt for U.S. Appl. No. 29/557,914, filed Mar. 14, 2016.
Decision of Refusal received for Japanese Patent Application No. 2018-555932, mailed on Oct. 27, 2020, 6 pages.
Decision to Grant a Patent received for Japanese Patent Application No. 2020-152565, mailed on Apr. 12, 2022, 5 pages.
Decision to Grant mailed Jan. 18, 2017 for Russian Application No. 2016503074, 4 pages.
Decision to Grant received for Russian Patent Application No. 2016503074/49, mailed on Jan. 18, 2017, 4 pages.
English Translation of Office Action for Korean Patent Application No. 10-2017-7037332, mailed on Dec. 25, 2018, 7 pages.
European Search Report received for EP Patent Application No. 21212962.1, mailed on Mar. 17, 2022, 6 pages.
Extended European Search Report received for EP Patent Application No. 21197532.1, mailed on Apr. 11, 2022, 8 pages.
U.S. Appl. No. 29/687,461, filed Apr. 12, 2019.
U.S. Appl. No. 29/687,464, filed Apr. 12, 2019.
U.S. Appl. No. 29/687,469, filed Apr. 12, 2019.
U.S. Appl. No. 29/687,471, filed Apr. 12, 2019.
Design U.S. Appl. No. 29/705,487, filed Sep. 12, 2019.
U.S. Appl. No. 15/737,673, filed Dec. 18, 2017.
International Preliminary Report on Patentability for Application No. PCT/EP2016/064756, mailed on Sep. 28, 2017, 9 pages.
International Preliminary Report on Patentability for Application No. PCT/EP2017/061518, mailed on Aug. 17, 2018, 16 pages.
International Preliminary Report on Patentability for Application No. PCT/EP2017/061519, mailed on Jul. 25, 2018,, 22 pages.
International Preliminary Report on Patentability for Application No. PCT/EP2017/061526, mailed on Nov. 22, 2018, 10 pages.
International Preliminary Report on Patentability for Application No. PCT/EP2017/068675, mailed on Aug. 27, 2018, 7 pages.
International Preliminary Report on Patentability for International Application No. PCT/EP2017/061520, mailed on Jul. 17, 2018, 11 pages.
International Preliminary Report on Patentability for International Application No. PCT/EP2017/061523, mailed on Jul. 23, 2018, 14 pages.
International Search Report and Written Opinion for Application No. PCT/EP2017/061519, mailed on Dec. 15, 2017, 22 pages.
International Search Report and Written Opinion for Application No. PCT/EP2017/061520, mailed on Sep. 11, 2017, 13 pages.
International Search Report and Written Opinion for Application No. PCT/EP2017/061523, mailed on Sep. 11, 2017, 13 pages.
International Search Report and Written Opinion for Application No. PCT/EP2017/068675, mailed on Nov. 9, 2017, 15 pages.
International Search Report for Application No. PCT/EP2016/064756, mailed on Oct. 5, 2016, 2 pages.
International Search Report for Application No. PCT/EP2017/061518, mailed on Aug. 1, 2017, 4 pages.
International Search Report for Application No. PCT/EP2017/061526, mailed on Aug. 2, 2017, 4 pages.
Notice of Opposition for European Patent Application No. 16738688.7 (EP3313217), mailed on Jun. 28, 2022, 20 pages.
Notice Of Reasons for Refusal for Japanese Application No. 2020-152565, mailed on Jun. 29, 2021, 5 pages.
Notice Of Reasons for Refusal for Japanese Application No. 2020-152565, mailed on Nov. 24, 2021, 12 pages.
Notice of Reasons for Refusal received for Japanese Patent Application No. 2017-567106, mailed on Nov. 20, 2018, 6 pages.
Notice of Reasons for Rejection for Japanese Application No. 2020-121968, mailed on Jun. 15, 2021, 8 pages.
Office Action and Search Report received for Chinese Patent Application No. 201680037678.4, mailed on Jan. 6, 2020, 10 pages.
Office Action dated Jul. 13, 2020 for Chinese Application No. 201780026927.4, 15 pages.
Office Action for Brazilian Application No. 112017027824-3, mailed on Jan. 9, 2022, 6 pages.
Office action for Brazilian Application No. 112018073458-6, mailed on Jul. 6, 2022, 7 pages.
Office action for Brazilian Application No. 112018073458-6, mailed on Sep. 28, 2021, 4 pages.
Office Action for Chinese Application No. 2017800293080.0 mailed on Jul. 22, 2020, 14 pages.
Office Action for Chinese Application No. 201780026927.4, mailed on Dec. 14, 2020, 5 pages.
Office Action for Japanese Application No. 2021-200209, mailed on Mar. 15, 2022, 5 pages.

(56) References Cited

OTHER PUBLICATIONS

Office Action For Korean Application No. 10-2019-7027490, mailed on Sep. 1, 2021, 12 pages.
Office Action for Malaysian Application No. PI2018704088, mailed on May 31, 2022, 4 pages.
Office Action For Russian Application No. 201811038, mailed on Aug. 26, 2021, 7 pages.
Office Action mailed Jan. 10, 2020 for Indian Application No. 201847042184, 5 pages.
Office Action mailed Mar. 10, 2020 for Japanese Application No. 2018-555932, 10 pages.
Office Action mailed Aug. 17, 2020 for Chinese Application No. 201780028992.0, 13 pages.
Office Action mailed Feb. 18, 2020 for Japanese Application No. 2018-559712, 6 pages.
Office Action mailed Feb. 25, 2020 for Japanese Application No. 2018-554526, 12 pages.
Office Action mailed Jan. 28, 2020 for Japanese Application No. 2018-551932, 6 pages.
Office Action mailed Jun. 28, 2019 for Russian Application No. 2018139838, 5 pages.
Office Action mailed Jan. 6, 2020 for Chinese Application No. 201680037678.4, 10 pages.
Office Action mailed dated Feb. 25, 2020 for Japanese Application No. 2018-554501, 12 pages.
Office Action received for Canadian Patent Application No. 2,989,260, mailed on Jun. 18, 2021, 3 pages.
Office Action received for Chinese Application No. 201680037678.4, mailed on Apr. 2, 2021, 16 pages.
Office Action received for Korean Application No. 10-2018-7032781, mailed on Jun. 16, 2020, 9 pages.
Office Action received for Korean Application No. 10-2018-7032794, mailed on Jun. 17, 2020, 15 pages.
Office Action received for Russian Patent Application No. 2019504647, mailed on Jun. 4, 2020, 11 pages.
Office Action received for Japanese Application No. 2018-555932, mailed on Oct. 27, 2020, 6 pages.
Search Report mailed Dec. 25, 2019 for Chinese Application No. 201680037678.4, 2 pages.
Second Office Action dated May 19, 2021 for Chinese Application No. 2017800293080, 18 pages.
Second office Action received for Chinese Application No. 201680037678.4, mailed on Sep. 28, 2020, 21 pages.
Written Opinion for Application No. PCT/EP2017/061526, mailed on Aug. 2, 2017, 8 pages.
Written Opinion received for Application No. PCT/EP2016/064756, mailed on Oct. 5, 2016, 4 pages.
Naughton, et al., U.S. Appl. No. 62/185,227, filed Jun. 26, 2015.
Invitation to Pay Additional Fees received for PCT Patent Application No. PCT/EP2017/061519, mailed on Sep. 8, 2017, 13 pages.
"FAQ About the Mechanical Properties of PEEK", PEEK International, May 30, 2024, 3 pages.
"Office Action received for Malaysian Patent Application No. PI 2018704088, mailed on Sep. 3, 2024", 4 pages (Official Copy Only).
"Notice of Allowance received for Japanese Patent Application No. 2023-215950, mailed on Jan. 7, 2025", 6 pages (3 pages of English Translation and 3 pages of Official Copy).
"Notice of Opposition Proceedings received for European Patent Application No. 16738688.7, mailed on Sep. 27, 2023", 17 pages.
"Office Action received for Chinese Patent Application No. 202110774417.3, mailed on Nov. 13, 2023", 11 pages (5 pages of English Translation and 6 pages of Official Copy).
"Office Action received for Chinese Patent Application No. 202210148348.X, mailed on Jun. 13, 2024", 13 pages (7 pages of English Translation and 6 pages of Official Copy).
"Request for Invalidation received for Chinese Patent Application No. 201780029308.0, mailed on Apr. 22, 2024", 284 pages (142 pages of English Translation and 142 pages of Official Copy).
"Statement Setting out the Grounds of Appeal received for European Patent Application No. 16738688.7, mailed on Apr. 11, 2024", 12 pages.
E-LIVI8 Vaporizer , "E-Livi8 Herbal Vaporizer", Available Online at: https://www.youtube.com/watch?v=S3bAYHIf_i4, Dec. 19, 2014, 4 pages.
Vaporizor Reviews , "Goboof Alfa Portable Vaporizer Review", Available Online at: https://www.youtube.com/watch?v=I39A9OXp-yl, Nov. 22, 2014, 2 pages.

* cited by examiner

APPARATUS FOR HEATING SMOKABLE MATERIAL

CROSS REFERENCE TO RELATED APPLICATION

This application is a continuation of U.S. application Ser. No. 17/445,850, filed Aug. 25, 2021, which is a continuation of U.S. application Ser. No. 15/737,673 filed Dec. 18, 2017, which in turn is a U.S. National Phase entry of PCT Application No. PCT/EP2016/064756, filed Jun. 24, 2016, and issued as U.S. Pat. No. 11,134,717 on Oct. 5, 2021, which claims priority from U.S. Provisional Application No. 62/185,227, filed Jun. 26, 2015, each of which is fully incorporated herein by reference.

TECHNICAL FIELD

The present disclosure relates to apparatus arranged to heat smokable material.

BACKGROUND

Articles such as cigarettes, cigars and the like burn tobacco during use to create tobacco smoke. Attempts have been made to provide alternatives to these articles, which burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

SUMMARY

According to the present disclosure, there is provided an apparatus arranged to heat smokable material to volatilize at least one component of the smokable material, the apparatus comprising: a housing; the housing having a first opening at a first end through which smokable material can pass so as to be received within and removed from the apparatus in use; the housing having a second opening at a second end opposed from the first end; the housing having a chamber between the first and second openings; at least one heater arranged within the housing for heating smokable material removably received within the chamber in use; whereby a user can access the chamber through at least the second opening to clean within the apparatus.

The access through at least the second opening particularly enables a user to clean within the chamber and optionally within the heater at the second end. In certain examples, the user is easily able to clean through substantially the whole of the chamber.

In an exemplary embodiment, the apparatus comprises a door for selectively covering the second opening, the door being movable between a first position in which the second opening is closed by the door and a second position in which the second opening is open. In an exemplary embodiment, the door is connected to the housing by a hinge.

In an exemplary embodiment, the housing is provided by a chassis and a first side panel and a second side panel, the first and second side panels being fixable to the chassis, the first and side panels being arranged to secure the door when the first and second side panels are fixed to the chassis. In the case of for example a hinged door, the side panels may retain a pivot pin of the door in position.

In another exemplary embodiment, the door is slidably connected to the housing so that the door can be slid between the first position and the second position.

In an exemplary embodiment, the chamber has a region of reduced internal diameter towards the second end to provide a stop for smokable material passed through the first opening in use. In use, this helps locate the smokable material at a predetermined position within the chamber.

In an exemplary embodiment, the apparatus comprises a hollow tube located within the chamber at the second end. In an exemplary embodiment, the hollow tube at the second end provides a region of reduced internal diameter towards the second end to provide a stop for smokable material passed through the first opening in use. In an exemplary embodiment, the hollow tube at the second end is arranged to support the heater at the second end. Thus, in this particular embodiment, the hollow tube both helps locate the smokable material at a predetermined position within the chamber and supports the heater at the second end.

In an exemplary embodiment, the apparatus comprises a hollow tube located within the chamber at the first end, the hollow tube at the first end being arranged to support the heater at the first end.

In an exemplary embodiment, the heater has a hollow interior and the chamber is defined at least in part by the hollow interior of the heater which receives smokable material in use.

In an exemplary embodiment, the heater is formed of plural heating elements.

In an exemplary embodiment, the apparatus comprises a heat insulator surrounding the heater for reducing heat loss from the heater to the exterior of the apparatus.

BRIEF DESCRIPTION OF THE DRAWINGS

Embodiments of the disclosure will now be described, by way of example only, with reference to the accompanying drawings, in which.

DETAILED DESCRIPTION

As used herein, the term "smokable material" includes materials that provide volatilized components upon heating, typically in the form of an aerosol. "Smokable material" includes any tobacco-containing material and may, for example, include one or more of tobacco, tobacco derivatives, expanded tobacco, reconstituted tobacco or tobacco substitutes. "Smokable material" also may include other, non-tobacco products, which, depending on the product, may or may not contain nicotine. "Smokable material" may for example be in the form of a solid, a liquid, a gel or a wax or the like. "Smokable material" may for example also be a combination or a blend of materials.

Apparatus is known that heats smokable material to volatilize at least one component of the smokable material, typically to form an aerosol which can be inhaled, without burning or combusting the smokable material. Such apparatus is sometimes described as a "heat-not-burn" apparatus or a "tobacco heating product" or "tobacco heating device" or similar. Similarly, there are also so-called e-cigarette devices, which typically vaporize a smokable material in the form of a liquid, which may or may not contain nicotine. The smokable material may be in the form of or provided as part of a rod, cartridge or cassette or the like which can be inserted into the apparatus. A heater for heating and volatilizing the smokable material may be provided as a "permanent" part of the apparatus or may be provided as part of the smoking article or consumable which is discarded and replaced after use. A "smoking article" in this context is a device or article or other component that includes or contains in use the smokable material, which in use is heated to volatilize the smokable material, and optionally other components.

Figure 1:
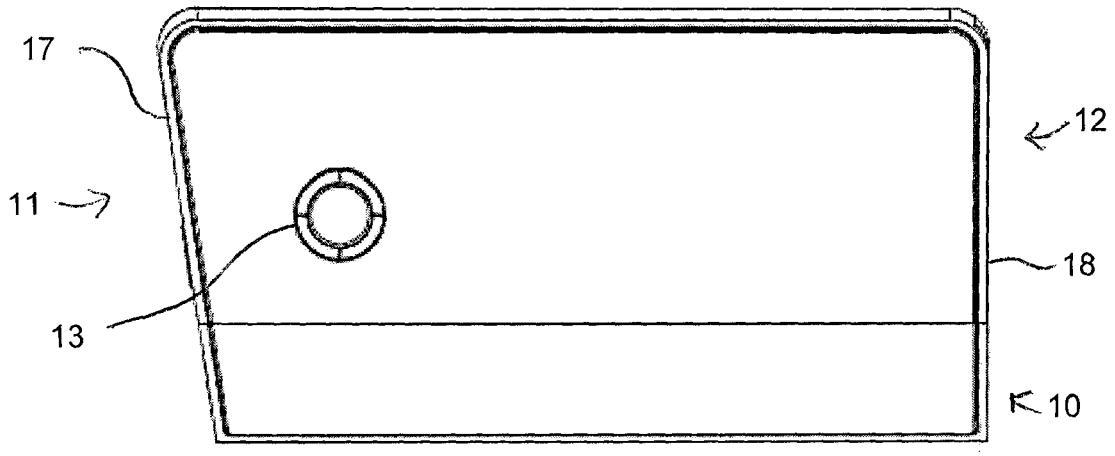
FIG. 1 shows a perspective view of an example of an apparatus for heating a smokable material.
Figure 2:
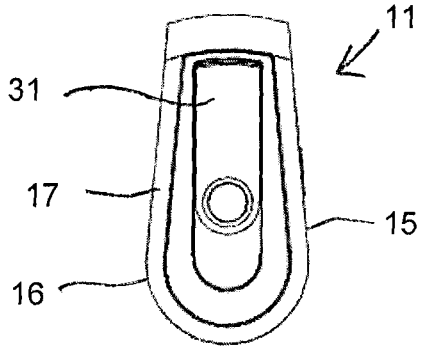
FIG. 2 shows a view from one end of the apparatus of FIG. 1.
Figure 3:
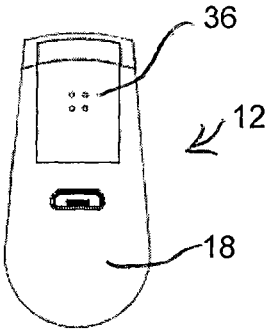
FIG. 3 shows a view from the other end of the apparatus of FIG. 1.

Referring to FIGS. 1 to 3, there are shown respectively a side view, a first end view and a second end view of an example of an apparatus 10 arranged to heat smokable material to volatilize at least one component of the smokable material, typically to form an aerosol which can be inhaled. The apparatus 10 is a heating apparatus 10 which releases compounds by heating, but not burning, the smokable material. The first end 11 is sometimes referred to herein as the mouth end 11 and the second end 12 is sometimes referred to herein as the distal end 12. The apparatus 10 has an on/off button 13 to allow the apparatus 10 as a whole to be switched on and off as desired by a user.

Figure 4:
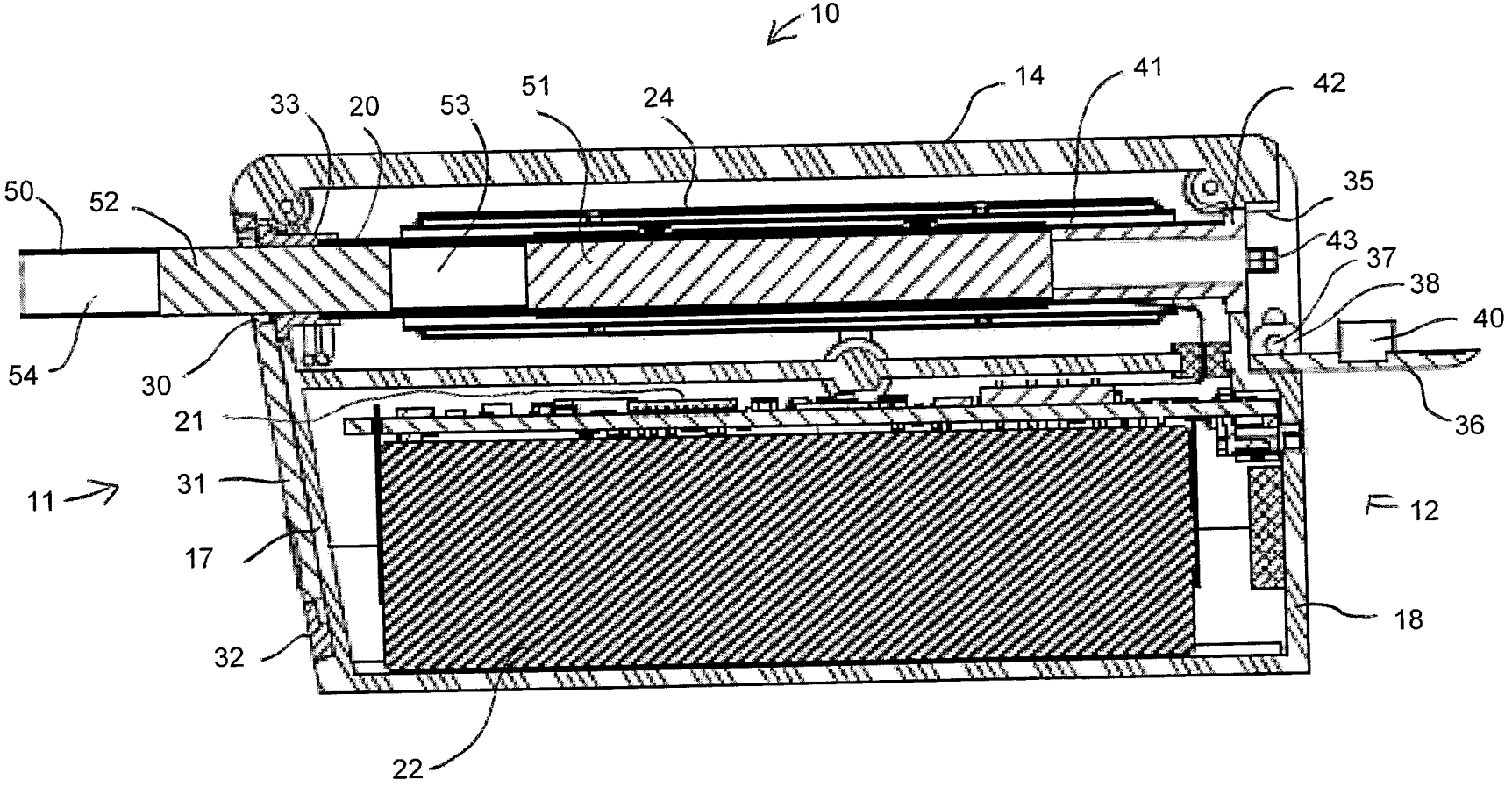
FIG. 4 shows a lateral cross-sectional view of the apparatus of FIG. 1 with smokable material inserted.
Figure 5:
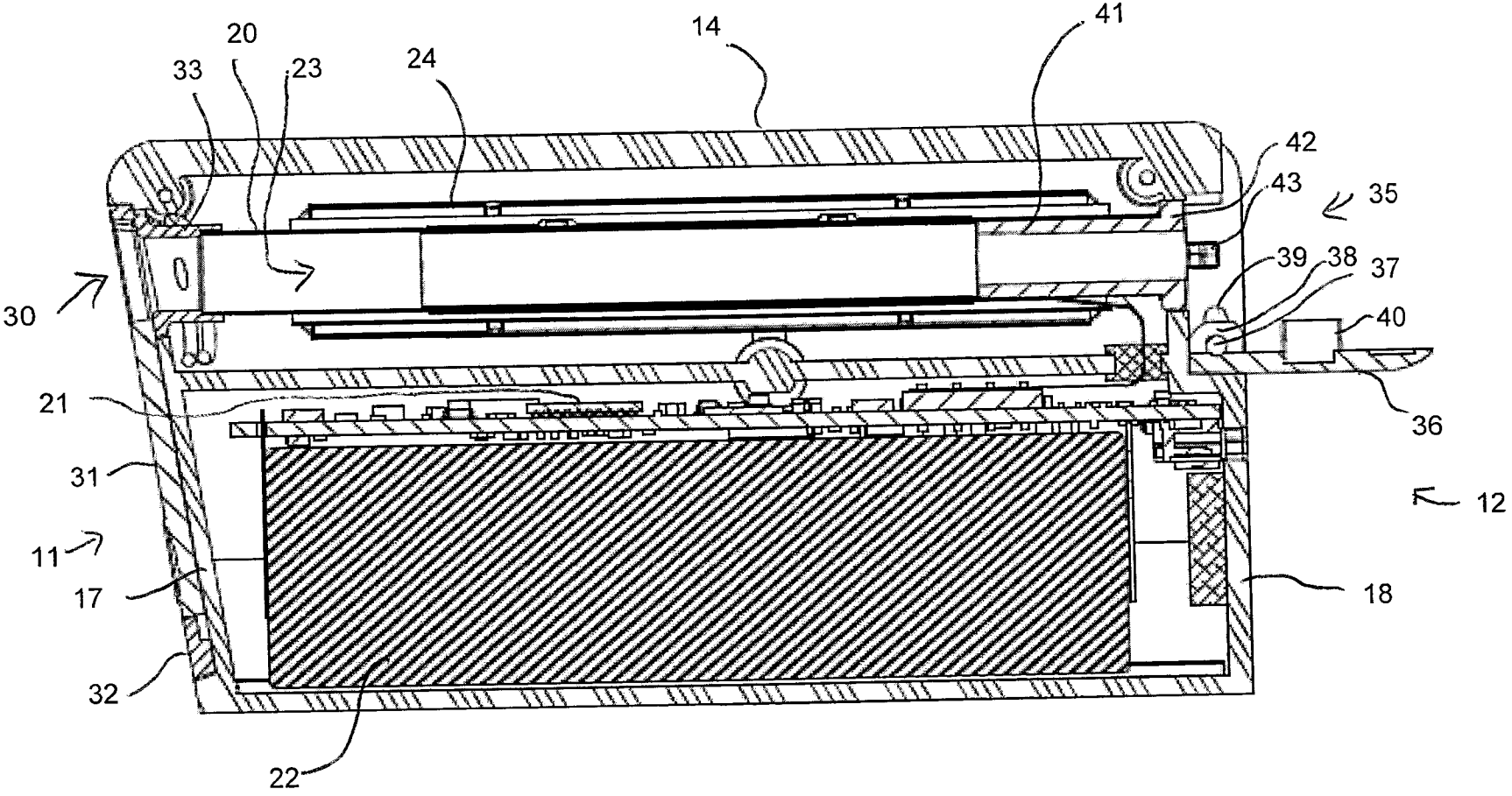
FIG. 5 shows a lateral cross-sectional view of the apparatus of FIG. 1 with no smokable material inserted.
Figure 6:
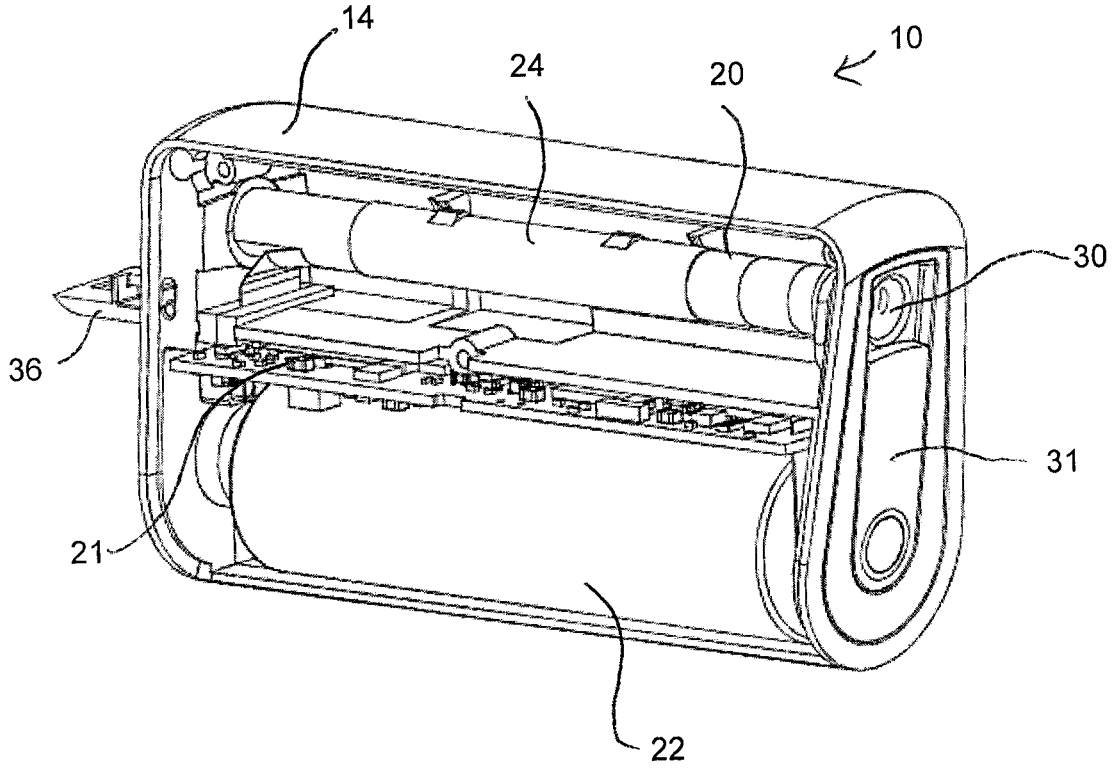
FIG. 6 shows a perspective view of the apparatus of FIG. 1 with a side panel removed.

Referring additionally to the cross-sectional views of FIGS. 4 and 5 and the perspective view of FIG. 6, the apparatus 10 provides a housing for locating and protecting various internal components of the apparatus 10. In the example shown, the apparatus 10 is formed of one or more "chassis" parts and one or more side panels. In the particular example shown here, the apparatus 10 has one main chassis 14 and two side panels 15, 16. During assembly of the apparatus 10, various internal components of the apparatus 10 are located in and/or fixed to the chassis 14 and the one or more side panels 15, 16 are then fixed to the chassis 14. The one or more side panels 15, 16 may be removably fixed to the chassis 14, to permit easy access to the interior of the apparatus 10, or may be "permanently" fixed to the chassis 14, for example to deter a user from accessing the interior of the apparatus 10. In the particular example shown here, the chassis 14 provides at least in part the front wall 17 of the apparatus 10 at the first or mouth end 11 and also provides at least in part the rear wall 18 of the apparatus at the second or distal end 12. In an example the chassis 14 and two side panels 15, 16 are made of a plastics material, including for example glass-filled nylon formed by injection molding, though other materials and other manufacturing processes may be used.

The chassis 14 has located or fixed therein a heater 20, control circuitry 21 and a power source 22. In this example, the heater 20, the control circuitry 21 and the power source 22 are laterally adjacent (that is, adjacent when viewed from an end, such as in the views of FIGS. 2 and 3), with the control circuitry 21 being located generally between the heater 20 and the power source 22, though other locations are possible. The control circuitry 21 may include a controller, such as a microprocessor arrangement, configured and arranged to control the heating of the smokable material as discussed further below. The power source 22 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 22 is electrically coupled to the heater 20 to supply electrical power when required and under control of the control circuitry 21 to heat the smokable material (as discussed, to volatilize the smokable material without causing the smokable material to burn). An advantage of locating the power source 22 laterally adjacent to the heater 20 is that a physically large power source 22 may be used without causing the apparatus 20 as a whole to be unduly lengthy. As will be understood, in general a physically large power source 22 has a higher capacity (that is, the total electrical energy that can be supplied, often measured in Amp-hours or the like) and thus the battery life for the apparatus 10 can be longer.

In one example, the heater 20 is generally in the form of a hollow cylindrical tube, having a hollow interior heating chamber 23 into which smokable material is inserted for heating in use. Different arrangements for the heater 20 are possible. For example, the heater 20 may be formed of a single heating element or may be formed of plural heating elements aligned along the longitudinal axis of the heater 20. The (or each) heating element may be annular or tubular, or at least part-annular or part-tubular around its circumference. In an example, the (or each heating element may be a thin film heater. In another example, the (or each) heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding. In one particular example, the heater 20 is formed of a polyimide substrate on which is formed one or more heating elements and which is supported by a stainless steel support tube. The heater 20 is dimensioned so that substantially the whole of the smokable material when inserted is located within the heating element(s) of the heater 20 so that substantially the whole of the smokable material is heated in use. The (or each) heating element may be arranged so that selected zones of the smokable material can be independently heated, for example in turn (over time) or together (simultaneously) as desired.

The heater 20 in this example is surrounded along at least part of its length by a thermal insulator 24. The insulator 24 helps to reduce heat passing from the heater 20 to the exterior of the apparatus 10. This helps to keep down the power requirements for the heater 20 as it reduces heat losses generally. The insulator 24 also helps to keep the exterior of the apparatus 10 cool during operation of the heater 20. In one example, the insulator 24 may be a double-walled sleeve which provides a low pressure region between the two walls of the sleeve. That is, the insulator 24 may be for example a "vacuum" tube, i.e. a tube that has been at least partially evacuated so as to minimize heat transfer by conduction and/or convection. Other arrangements for the insulator 24 are possible, including using heat insulating materials, including for example a suitable foam-type material, in addition to or instead of a double-walled sleeve.

The front wall 17 of the chassis 14 has an opening 30 at the mouth end 11 of the apparatus 10 through which in use smokable material may be passed to be inserted into the apparatus 10 and removed from the apparatus 10 by a user. A door 31 is provided at the mouth end 11. The door 31 can be opened so as to allow smokable material to be passed through the opening 30 to be inserted into and removed from the apparatus 10 during periods of use and can be closed to close the opening 30 to keep the interior of the apparatus 10 clean during periods of non-use and avoiding damage to the interior of the apparatus 10. The door 31 in this example is a sliding door, which can be slid up and down to close and open the opening 30. In other examples, the door 31 may be a hinged door or other arrangements may be provided. The door 31 in this example is provided in conjunction with a mouthpiece component 32 which is fixed to the front wall 17 of the chassis 14 (for example by gluing) during manufacture of the apparatus 10 and which captures the door 31 to allow the door 31 to slide open and closed. The mouthpiece component 32 and door 31 may be formed of for example a plastics material, including for example glass-filled nylon. The mouthpiece component 32 in this example has an inwardly facing collar 33 which projects through the opening 30 into the interior of the apparatus 10 and which can assist in supporting and locating the heater 20, as will be discussed further below. Referring here particularly to FIG. 4, this shows a rod 50 which includes smokable material 51 inserted partly through the front opening 30 so that (at least) the smokable material 51 is located within the heating chamber 23 of the heater 20 so that the smokable material 51 is heated when the heater 20 is energized.

Figure 8:
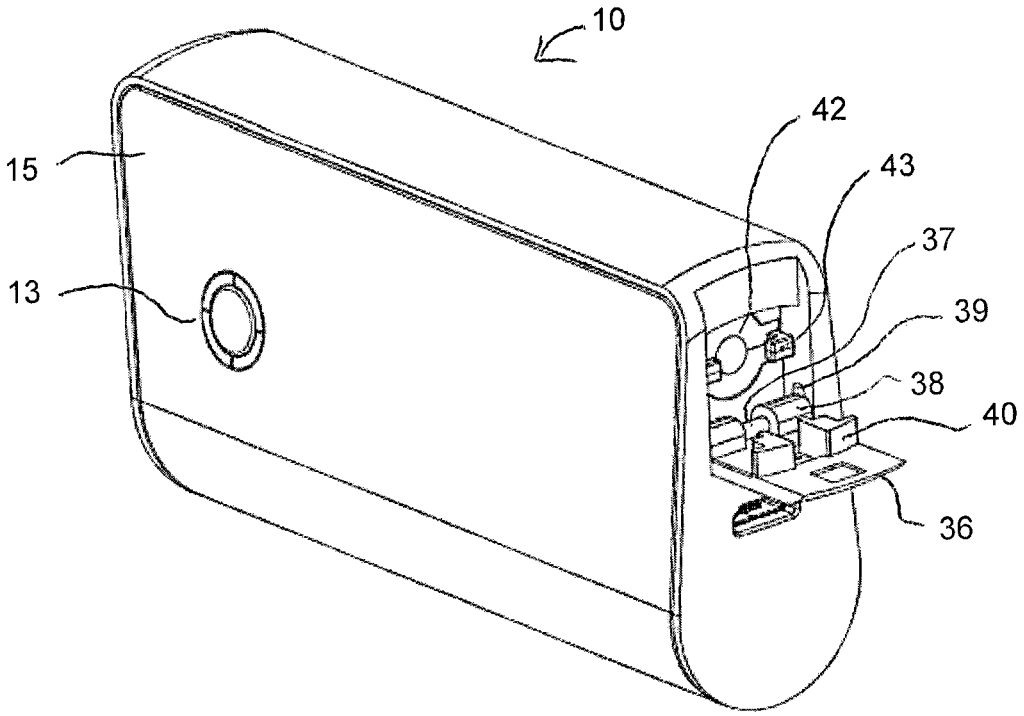
FIG. 8 shows a perspective view of the apparatus of FIG. 1 with a door open at an end.

The rear wall 18 of the chassis 14 has an opening 35 at the distal end 12 of the apparatus 10. A door 36 is provided at the distal end 12. The door 36 can be opened so as to allow access to the opening 35 at the distal end 12 and can be closed to close the opening 35 at the distal end 12. The door 36 at the distal end 12 in this example is a hinged door. In other examples, the door 36 may be a sliding door or other arrangements may be provided. In the case that the door 36 at the distal end 12 is a hinged door, the hinge may be provided as a "living hinge". In one embodiment, the door 36 is a separate component and the hinge for the door 36 is a barrel hinge. In that case, a pivot pin 37 is located within one or more hollow hinge barrels 38 provided integrally with or fixed to the door 36 and also within one or more recesses or hollow clips 39 provided integrally with or fixed to the chassis 14 in the region of the opening 35 to hingedly fix the door 36 to the chassis 14. The door 36 has one or more clips or projections 40 or the like which resiliently engage with the surrounding portion(s) of the chassis 14 or with clips which may be provided by a separate hollow tube 41 discussed further below to clip the door 36 in its closed position. The door 36 can be seen most clearly in FIG. 8. The door 36 may be formed of for example a plastics material, including for example ABS (acrylonitrile butadiene styrene).

In the assembled apparatus 10, the heater 20 generally in the form of a hollow cylindrical tube is located within the chassis 14 so that one end of the hollow tube is in fluid communication with the opening 30 at the mouth end 11 and the other end of the hollow tube is in communication with the opening 35 at the distal end.

In use, the user closes the door 36 at the distal end 12 to close the opening 35 at the distal end 12 and opens the door 30 at the mouth end 11 to open the opening 30 at the mouth end 11. The user then inserts the rod 50 that includes smokable material 51 through the opening 30 at the mouth end 11 into the heating chamber 23 of the heater 20, operates the apparatus 10 to heat the smokable material 51 to generate an aerosol for inhaling as desired, and then removes the rod 50 with used smokable material 51 from the apparatus 10 through the opening 30 at the mouth end 11. Importantly, the user can open the door 36 at the distal end 12 to open the opening 35 at the distal end 12 after the apparatus 10 has been used. The opening 35 at the distal end 12 provides access for the user to the interior of the apparatus 10, particularly in the region of the opening 35 at the distal end 12. This allows the user to clean within the interior of the apparatus 10 in the region of the opening 35 at the distal end 12 when necessary and as desired. This access at the distal end 12 particularly enables the user to clean within the heater 20 and the heating chamber 23 at the distal end 12. Indeed, as the heater 20 is located between the openings 30, 35 at the mouth end 11 and the distal end 12 respectively, and the hollow heater 20 in effect defines a straight through-bore through the whole apparatus 10 between the mouth end opening 30 and the distal end opening 35, the user is easily able to clean through substantially the whole of the interior hollow heating chamber 23. For this, the user can access the heating chamber 23 via either opening 30, 35 at choice. The user may use one or more various cleaning devices for this purpose, including for example a classic pipe cleaner or a brush or the like.

In an example, the heating chamber 23 has a region of reduced internal diameter towards the distal end 12. This provides an end stop for smokable material passed through the first opening 30 at the mouth end 11, to prevent the smokable material being passed straight out through the second opening 35 at the distal end 12.

In the example shown, this region of reduced internal diameter is provided by a hollow tube 41 which is located within the end of the heating chamber 23 towards the distal end 12. An example of the hollow tube 41 is shown most clearly in FIG. 7. The hollow tube 41 in this example has an outwardly extending head or flange 42. The hollow tube 41 may be formed of for example a plastics material, including for example polyether ether ketone (PEEK). During manufacture of the apparatus 10, the hollow tube 41 is inserted from the outside into the opening 35 at the distal end 12, with the head or flange 42 providing a stop against the chassis 14 to locate the hollow tube 41 at the predetermined position. The hollow tube 41 may be fixed in place, for example by glue. The heater 20 is located within the chassis 14, with the hollow tube 41 entering the distal end of the interior chamber 23 of the heater 20. Accordingly, in this case, the hollow tube 41 provides the region of reduced internal diameter within the heating chamber 23 which acts as a stop for the smokable material inserted into the interior chamber 23 of the heater 20, and also supports and locates the heater 20 within the apparatus 10 at the distal end 12. Discussing further the support and location of the heater 20 within the apparatus 10, the inwardly facing collar 33 of the mouthpiece component 32 at the mouth end 11 in the example described above similarly projects into the mouth end of the interior chamber 23 of the heater 20, which therefore supports and locates the heater 20 within the apparatus 10 at the mouth end 11.

Figure 7:
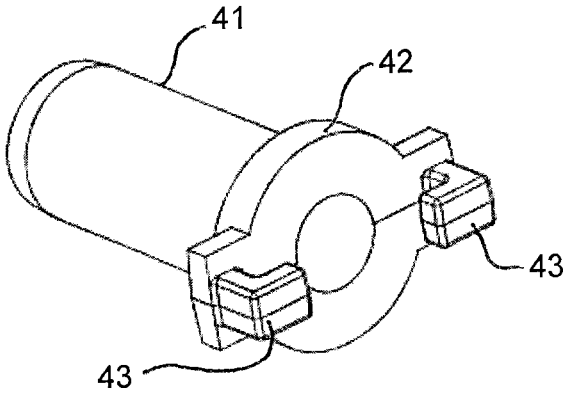
FIG. 7 shows a perspective view of a hollow tube component of the apparatus of FIG. 1.

In this example, as shown in for example FIG. 7, the head or flange 42 of the hollow tube 41 has opposed inwardly facing projections or clips 43. The clips or projections 40 of the door 36 respectively resiliently engage with the projections or clips 43 of the head or flange 42 of the hollow tube 41 when the door 36 is in the closed position, to retain the door 36 in the closed position.

Referring again particularly to FIG. 4, in one example the smokable material is provided as part of a consumable in the form of a cylindrical rod 50 which has or contains smokable material 51 at one end (which is the distal end, inserted into the chassis 14 in use). In this example, the rod 50 has at the other end (which is the mouth end) a mouthpiece assembly which includes one or more of a filter for filtering aerosol and/or a cooling element 52 for cooling aerosol. The filter/cooling element 52 is spaced from the smokable material by a space 53 and is also spaced from the mouth end by a further space 54.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An apparatus arranged to heat smokable material to volatilize at least one component of the smokable material, the apparatus comprising:

a housing, the housing having:

a first opening at a first end through which the smokable material can pass so as to be received within and removed from the apparatus in use, and a second opening at a second end opposed from the first end, and a chamber between the first opening and the second opening;

at least one heater arranged within the housing for heating the smokable material removably received within the chamber in use; and a hollow tube located within the chamber at the second end, wherein the hollow tube at the second end is arranged to support the heater at the second end;

wherein the chamber has a region of reduced internal diameter towards the second end to provide a stop for smokable material passed through the first opening in use.

2. The apparatus according to claim 1, wherein the hollow tube at the second end provides a region of reduced internal diameter towards the second end to provide a stop for smokable material passed through the first opening in use.

3. The apparatus according to claim 1, further comprising a hollow tube located within the chamber at the first end, the hollow tube at the first end being arranged to support the heater at the first end.

4. The apparatus according to claim 1, wherein the heater has a hollow interior and the chamber is defined at least in part by the hollow interior of the heater which receives the smokable material in use.

5. The apparatus according to claim 1, wherein the heater is formed of plural heating elements.

6. The apparatus according to claim 1, further comprising a heat insulator surrounding the heater for reducing heat loss from the heater to an exterior of the apparatus.

7. The apparatus according to claim 1, wherein a user can access the chamber through the first opening or the second opening to clean the apparatus.

8. The apparatus according to claim 1, wherein the hollow tube is arranged to support the heater in a longitudinal direction of the hollow tube.

9. The apparatus according to claim 1, wherein the hollow tube is elongate.

10. The apparatus according to claim 1, wherein the hollow tube is made of polyether ether ketone.

11. The apparatus according to claim 1, wherein the hollow tube is displaced axially from the heater.

12. The apparatus according to claim 1, wherein the hollow tube contacts the heater.

13. The apparatus according to claim 1, further comprising a door for selectively covering the second opening, the door being movable between a first position in which the second opening is closed by the door and a second position in which the second opening is open.

14. The apparatus according to claim 13, wherein the door is connected to the housing by a hinge.

15. The apparatus according to claim 13, wherein the housing is provided by a chassis and a first side panel and a second side panel, the first side panel and the second side panel being fixable to a chassis, the first side panel and the second side panel being arranged to secure the door when the first side panel and the second side panel are fixed to the chassis.

16. The apparatus according to claim 13, wherein the door is slidably connected to the housing so that the door can be slid between the first position and the second position.

* * * * *